US011187414B2

(12) United States Patent
Biagioli et al.

(10) Patent No.: US 11,187,414 B2
(45) Date of Patent: Nov. 30, 2021

(54) FUEL NOZZLE WITH IMPROVED SWIRLER VANE STRUCTURE

(71) Applicant: General Electric Company, Schenectady, NY (US)

(72) Inventors: Fernando Biagioli, Fislisbach (CH); Sebastiano Sorato, Zurich (CH); Teresa Marchione, Ennetbaden (CH)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/835,516

(22) Filed: Mar. 31, 2020

(65) Prior Publication Data

US 2021/0302021 A1 Sep. 30, 2021

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286; F23R 3/12
See application file for complete search history.

(56) References Cited

U.S. PATENT DOCUMENTS 4,714,407 A 12/1987 Cox et al.
5,351,477 A * 10/1994 Joshi ..... F23C 7/004 239/400
6,141,967 A * 11/2000 Angel ..... F23R 3/14 239/405
6,438,961 B2 8/2002 Tuthill et al.
6,993,916 B2 2/2006 Johnson et al.
8,393,157 B2 3/2013 Dinu
8,925,323 B2 1/2015 Zuo
2005/0268618 A1* 12/2005 Johnson ..... F23R 3/286 60/776
2008/0148736 A1* 6/2008 Ishizaka ..... F23R 3/14 60/737
2008/0289341 A1* 11/2008 Ishizaka ..... F23R 3/14 60/748

(Continued)

FOREIGN PATENT DOCUMENTS

KR 20190093303 A 8/2019

OTHER PUBLICATIONS

European Search Report Corresponding to Application No. 21162180 dated Aug. 6, 2021.

*Primary Examiner* — William H Rodriguez
(74) *Attorney, Agent, or Firm* — Dority & Manning, P.A.

(57) ABSTRACT

A fuel nozzle for a turbomachine includes a centerbody that extends axially with respect to a centerline of the fuel nozzle. A confining tube is positioned radially outward of the centerbody. A plurality of swirler vanes is disposed between the centerbody and the confining tube. Each of the plurality of swirler vanes includes a radially inner base and a radially outer tip. Each of the swirler vanes further includes an upstream portion that extends generally axially from a leading edge. A downstream portion extends from the upstream portion to a trailing edge. The downstream portion defines a bend length between the upstream portion and the trailing edge. The bend length at the radially outer tip is greater than the bend length at the radially inner base.

18 Claims, 6 Drawing Sheets

(56) References Cited

U.S. PATENT DOCUMENTS

| | | | | |
|---|---|---|---|---|
| 2009/0056336 | A1* | 3/2009 | Chila | F23R 3/286 60/737 |
| 2010/0269508 | A1* | 10/2010 | Saito | F23R 3/14 60/748 |
| 2010/0319350 | A1* | 12/2010 | Landry | F23R 3/14 60/748 |
| 2010/0326079 | A1* | 12/2010 | Zuo | F23R 3/14 60/748 |
| 2011/0005189 | A1* | 1/2011 | Uhm | F23N 5/242 60/39.281 |
| 2011/0285499 | A1 | 11/2011 | Nakamachi et al. | |
| 2012/0285173 | A1* | 11/2012 | Poyyapakkam | F23C 7/004 60/772 |
| 2014/0013764 | A1* | 1/2014 | Biagioli | F23R 3/14 60/748 |
| 2014/0123661 | A1* | 5/2014 | Biagioli | F23R 3/286 60/772 |
| 2015/0285499 | A1 | 10/2015 | Prade | |
| 2016/0010856 | A1* | 1/2016 | Biagioli | F23D 14/24 60/737 |
| 2016/0195266 | A1* | 7/2016 | Kim | B05B 7/04 239/406 |
| 2016/0281990 | A1* | 9/2016 | Stuttaford | F23R 3/14 |

* cited by examiner

FUEL NOZZLE WITH IMPROVED SWIRLER VANE STRUCTURE

FIELD

The present disclosure relates generally to turbomachine fuel nozzles. In particular, the present disclosure relates to swirler vane structures for use in a turbomachine fuel nozzle.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

Turbomachines typically include fuel nozzles in the combustor section. Each fuel nozzle is a component having one or more passages for delivering a mixture of fuel and air to a combustion chamber for ignition. A fuel nozzle often includes a swirler to improve mixing of the fuel and air into a consistent, homogeneous mixture prior to ignition. The swirler portion of the fuel nozzle includes a plurality of aerodynamic vanes extending radially from and circumferentially around a centerbody of the nozzle. The swirler vanes often include internal passages, which provide fuel through fuel holes defined on a surface of the swirler vanes. As fuel exits the fuel holes, it mixes with fluid, typically air, passing between the swirler vanes. The fuel/air mixture is then ignited within the combustion chamber to produce combustion gases that power the turbine section.

Often, to reduce emissions and/or to improve turndown capabilities, older turbomachine models are retrofitted to include a secondary combustion stage, which includes one or more axial fuel injectors that are generally located downstream from the primary combustion stage, e.g., the fuel nozzles. Typically, in order to operate, the axial fuel injectors require a large portion of compressed air, which was previously routed through only the fuel nozzles. As a result of the reduced compressed airflow to the primary fuel nozzles, conventional swirler vanes may produce flow separations in the swirler or downstream of the swirler, which can lead to detrimental effects on fuel nozzle performance, for example, flame holding. Generally, the reduced compressed airflow is often accompanied by a reduction in the bulk velocity of airflow across the swirler, which increases the risk of flame holding at the swirler surfaces.

Accordingly, a fuel nozzle with improved swirler vane structures that can operate at a reduced airflow, while maintaining a proper flame holding margin, is desired in the art.

BRIEF DESCRIPTION

Aspects and advantages of the swirler assemblies and turbomachines in accordance with the present disclosure will be set forth in part in the following description, or may be obvious from the description, or may be learned through practice of the technology.

In accordance with one embodiment, a fuel nozzle is provided. The fuel nozzle includes a centerbody that extends axially with respect to a centerline of the fuel nozzle. A confining tube is positioned radially outward of the centerbody. A plurality of swirler vanes is disposed between the centerbody and the confining tube. Each of the plurality of swirler vanes includes a radially inner base and a radially outer tip. Each of the swirler vanes further includes an upstream portion that extends generally axially from a leading edge. A downstream portion extends from the upstream portion to a trailing edge. The downstream portion defines a bend length between the upstream portion and the trailing edge. The bend length at the radially outer tip is greater than the bend length at the radially inner base.

In accordance with another embodiment, a turbomachine is provided. The turbomachine includes a compressor section, a turbine section, and a combustion section comprising a plurality of fuel nozzles. Each fuel nozzle of the plurality of fuel nozzles includes a centerbody that extends axially with respect to a centerline of the fuel nozzle. A confining tube is positioned radially outward of the centerbody. A plurality of swirler vanes is disposed between the centerbody and the confining tube. Each of the plurality of swirler vanes includes a radially inner base and a radially outer tip. Each of the swirler vanes further includes an upstream portion that extends generally axially from a leading edge. A downstream portion extends from the upstream portion to a trailing edge. The downstream portion defines a bend length between the upstream portion and the trailing edge. The bend length at the radially outer tip is greater than the bend length at the radially inner base.

These and other features, aspects and advantages of the present fuel nozzles and turbomachines will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present swirler assemblies and turbomachines, including the best mode of making and using the present systems and methods, directed to one of ordinary skill in the art, is set forth in the specification, which makes reference to the appended figures, in which.

DETAILED DESCRIPTION

Figure 1:
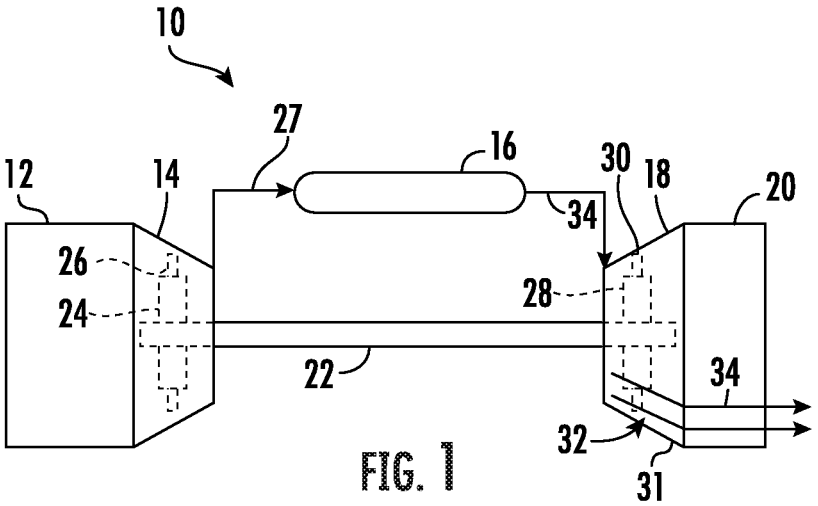
FIG. 1 is a schematic illustration of a turbomachine, in accordance with embodiments of the present disclosure.

Reference now will be made in detail to embodiments of the present fuel nozzles with improved swirler vane structures and turbomachines with such fuel nozzles, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows.

The term "radially" refers to the relative direction that is substantially perpendicular to an axial centerline of a particular component; the term "axially" refers to the relative direction that is substantially parallel and/or coaxially aligned to an axial centerline of a particular component; and the term "circumferentially" refers to the relative direction that extends around the axial centerline of a particular component.

Terms of approximation, such as "generally" or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to a land-based and/or industrial gas turbine unless otherwise specified in the claims. For example, the swirler assemblies as described herein may be used in any type of turbomachine including, but not limited to, a steam turbine, an aircraft gas turbine, or a marine gas turbine.

Figure 2:
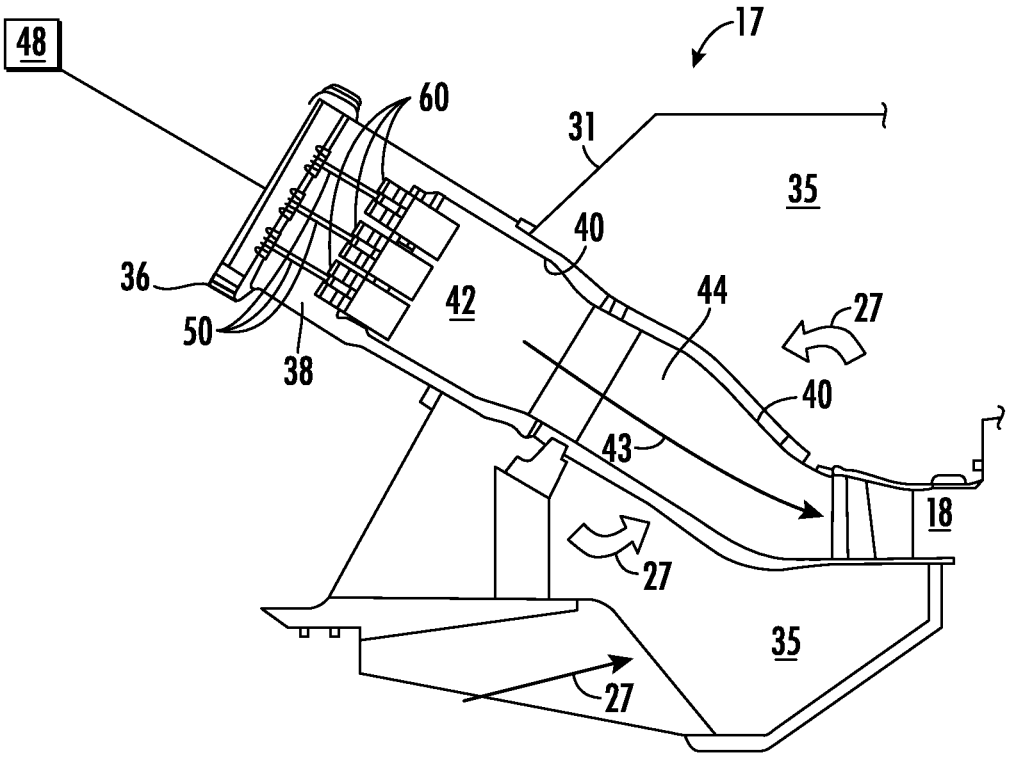
FIG. 2 illustrates a combustor suitable for use with the turbomachine of FIG. 1, in accordance with embodiments of the present disclosure.

As shown, the gas turbine 10 generally includes an inlet section 12, a compressor section 14 disposed downstream of the inlet section 12, a plurality of combustors 17 (as shown in FIG. 2) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air flows through the inlet section 12 and into the compressor section 14 where the air is progressively compressed, thus providing pressurized air 27 to the combustors of the combustor section 16. The pressurized air 27 is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

As shown in FIG. 2, the combustor 17 may be at least partially surrounded by the outer casing 31, which may be referred to as a compressor discharge casing. The outer casing 31 may at least partially define a high pressure plenum 35 that at least partially surrounds various components of the combustor 17. The high pressure plenum 35 may be in fluid communication with the compressor 14 (FIG. 1) to receive the compressed air 27 therefrom. An end cover 36 may be coupled to the outer casing 31. In particular embodiments, the outer casing 31 and the end cover 36 may at least partially define a head end volume or portion 38 of the combustor 17.

In particular embodiments, the head end portion 38 is in fluid communication with the high pressure plenum 35 and/or the compressor 14. One or more liners or ducts 40 may at least partially define a combustion chamber or zone 42 for combusting the fuel-air mixture and/or may at least partially define a hot gas path through the combustor as indicated by arrow 43, for directing the combustion gases 34 towards an inlet to the turbine 18.

In various embodiments, the combustor 17 includes at least one fuel nozzle 60 at the head end portion 38. As shown in FIG. 2, the fuel nozzle 60 may be disposed within the outer casing 31 downstream from and/or spaced from the end cover 36 of the combustor 17 and upstream from the combustion chamber 42. In particular embodiments, the fuel nozzle assembly 60 may be in fluid communication with fuel supply 48 via one or more fluid conduits 50. In many embodiments, the fluid conduit(s) 50 may be fluidly coupled and/or connected at one end to the end cover 36.

Figure 3:
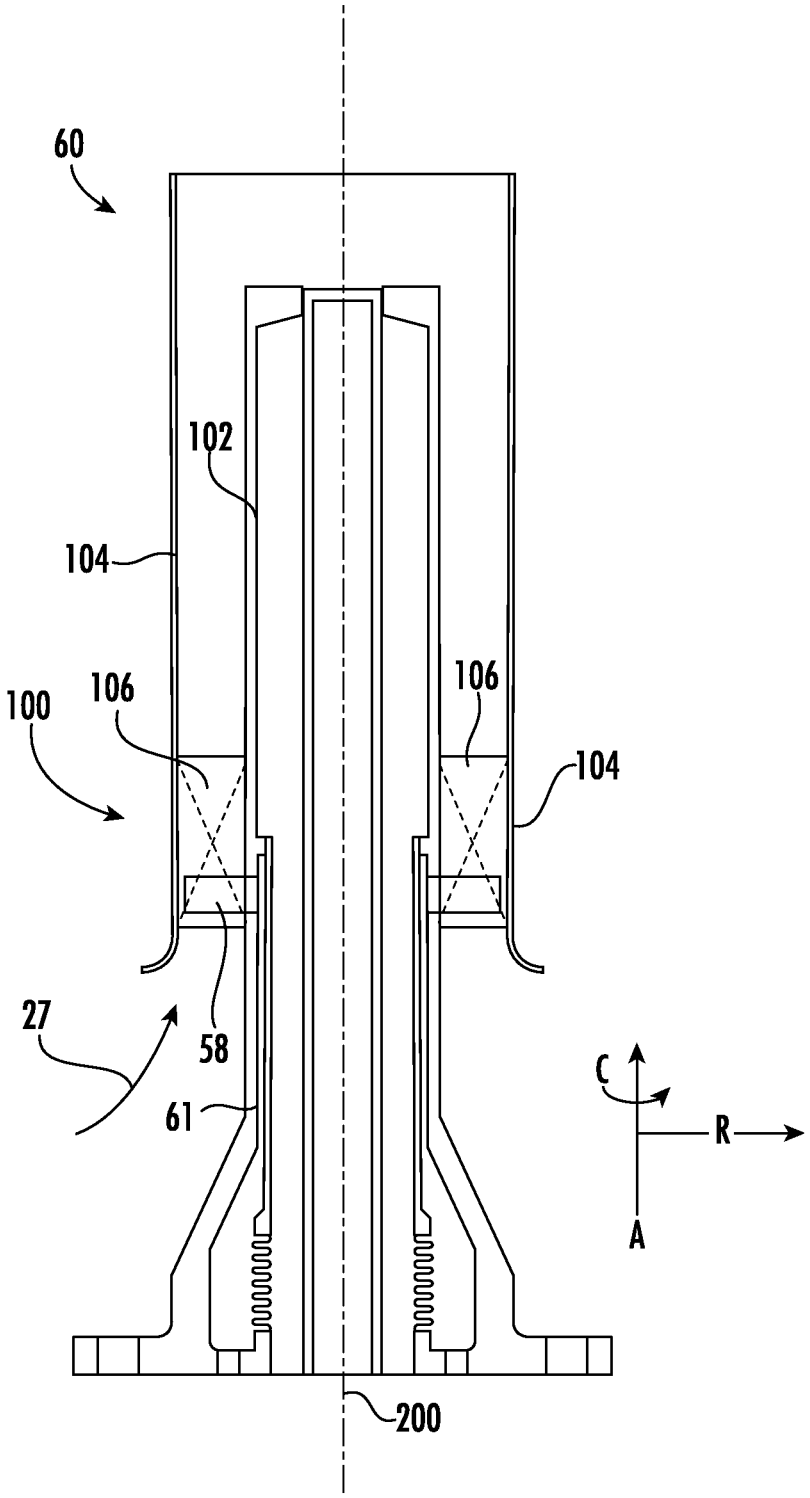
FIG. 3 illustrates a cross-sectional side view of a fuel nozzle for use within the combustor of FIG. 2, in accordance with embodiments of the present disclosure.

FIG. 3 shows an example of a fuel nozzle 60, as described herein. The fuel nozzle 60 may be used with the combustor 17 and the like. As shown, the fuel nozzle 60 may include a swirler portion 100. The fuel nozzle 60 may include a hub or centerbody 102 radially spaced apart from a confining tube 104. As shown, the centerbody 102 may be connected to the confining tube by one or more swirler vanes 106. The swirler vanes 106 may have a generally aerodynamic contour and may be configured to impart swirl on the air passing through the fuel nozzle 60. Each swirler vane 106 may include one or more fuel supply passages 58 therethrough. These fuel supply passages 58 may distribute gaseous fuel to gas fuel injection holes (not shown). Gaseous fuel may enter the swirler assembly 100 through one or more annular passages 61, which feed the fuel supply passages 58. The gaseous fuel may mix with the compressed air 27 as the fuel and air travel through the swirler portion 100, and, after mixing within the confining tube 104 of the fuel nozzle 60, the fuel/air mixture may enter the combustion zone 42 (FIG. 2) where combustion takes place.

Figure 4:
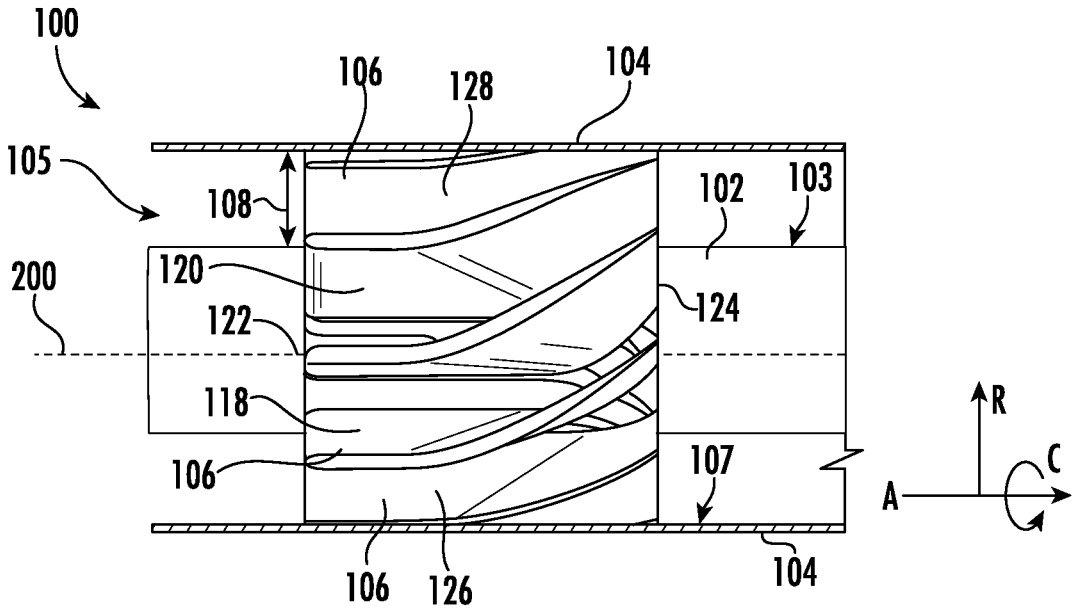
FIG. 4 illustrates a side view of a portion of the fuel nozzle of FIG. 3, in accordance with embodiments of the present disclosure.

FIG. 4 illustrates the swirler portion 100 having a section of the confining tube 104 of the fuel nozzle 60 cut away and showing the swirler vanes 106, in accordance with embodiments of the present disclosure. The swirler vanes 106 may be disposed radially between the centerbody 102 and the confining tube 104. As shown, the swirler portion 100 may include multiple swirler vanes 106, which function to enhance fuel/air mixing and to improve flame stabilization. In the embodiment shown in FIGS. 4 and 5, the swirler portion 100 includes ten circumferentially spaced swirler vanes 106. In other embodiments, the number of swirler vanes 106 may vary.

Compressed air 27 from the compressor section 14 may flow through an annular space 105 between the centerbody 102 and the confining tube 104, where the air 27 encounters the swirler vanes 106. The swirler vanes 106 may induce a swirling motion in the air in a clockwise or counterclockwise direction in the circumferential direction C. The swirler portion 100 may also include multiple fuel injection ports (not shown) defined through the swirler vanes 106. The fuel injection ports may direct fuel into the annular space 105 of the swirler portion 100 (that is, between adjacent swirler vanes 106) where the fuel contacts and mixes with the air. The swirler vanes 106 may induce a swirling motion to the fuel/air mixture as it moves through the confining tube 104 and into the combustion zone 42.

As shown in FIG. 4, the swirler portion 100 may define an axial direction A and a circumferential direction C, which extends around the axial direction A. The swirler portion 100 may also define a radial direction R perpendicular to the axial direction A.

Figure 6:
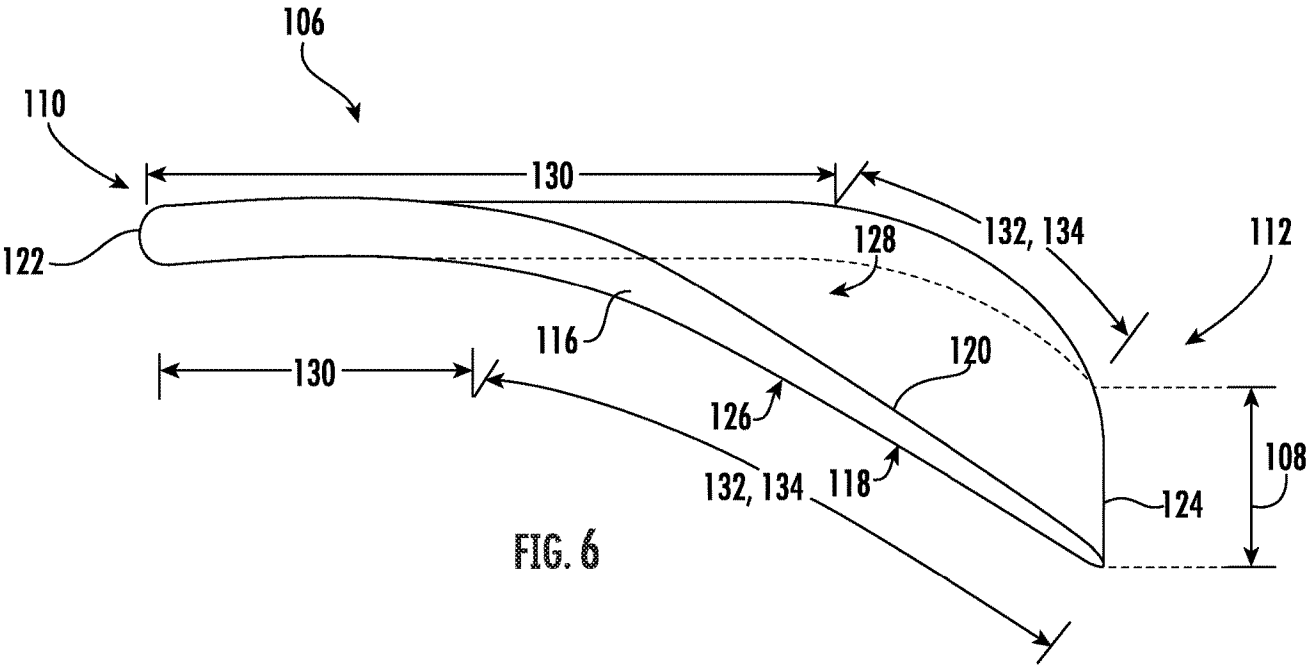
FIG. 6 illustrates a side view of a single swirler vane of the swirler vanes of FIG. 5, in accordance with embodiments of the present disclosure.

As shown in FIG. 4, the swirler portion 100 may further include a maximum radial distance or $R_{max}$ value. As shown, the $R_{max}$ value may be measured in the radial direction R from the axial centerline 200 of swirler portion 100 to the confining tube 104. Specifically, the $R_{max}$ value may be measured from the axial centerline 200 to an interior surface 107 of the confining tube 104. Further, as used herein, the $R/R_{max}$ value may be a percent and/or portion of the $R_{max}$ value, which may be used to indicate a location in the radial direction. For example, as shown in FIG. 4, when $R/R_{max}$ is equal to 0.5 (or 50% of the $R_{max}$ value), the location along the radial direction R is the outer surface 103 of the centerbody 102 and/or a radially inner base 114 (as shown in FIG. 6) of the swirler vane 106.

Figure 5:
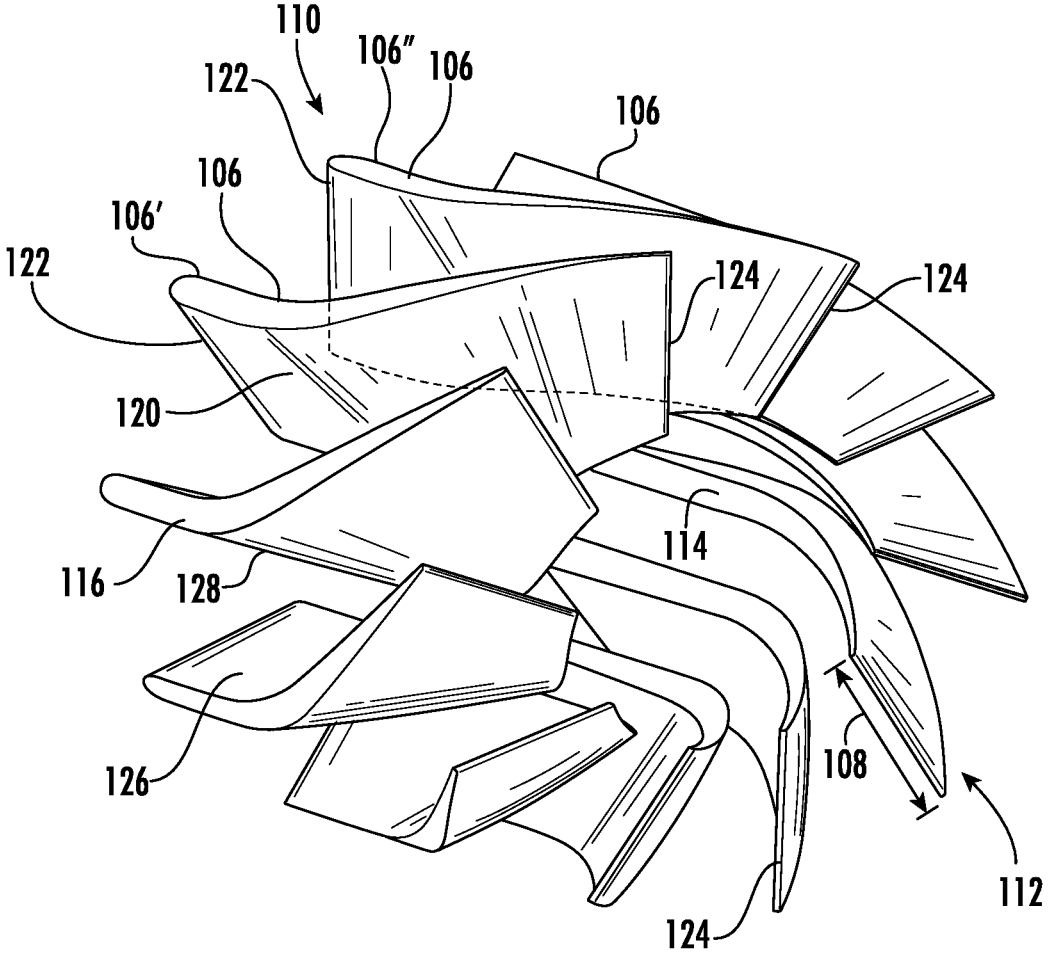
FIG. 5 illustrates a plurality of swirler vanes from the fuel nozzle of FIGS. 3 and 4, in accordance with embodiments of the present disclosure.

FIG. 5 illustrates the swirler vanes 106 isolated from the centerbody 102 and the confining tube 104, in accordance with embodiments of the present disclosure. As shown in FIGS. 4 and 5, the swirler vanes 106 may each include a radius 108 that extends between the centerbody 102 and the confining tube 104. Each of the swirler vanes 106 includes a leading edge 122 defined at an upstream end 110 and a trailing edge 124 defined at a downstream end 112. Air and/or fuel generally flow from the upstream end 110 to the downstream end 112.

In many embodiments, the swirler vanes 106 include a radially inner base 114 coupled to the centerbody 102. The swirler vanes 106 may extend radially between the radially inner base 114 and a radially outer tip 116. The swirler vanes 106 may each include a pressure side 118 and a suction side 120. The pressure side 118 may extend from the leading edge 122 to the trailing edge 124 and form a pressure side surface 126. The pressure side surface 126 may be have a generally aerodynamic contour and may, in many embodiments, be substantially arcuate. Air and/or fuel may generally flow against the pressure side 118 and may take a path corresponding to the pressure side surface 126. Likewise, the suction side 120 also extends from the leading edge 122 to the trailing edge 124 and forms a suction side surface 128. The pressure side surface 126 may be different from the suction side surface 128, i.e., may have a different aerodynamic contour. Accordingly, the surfaces 126, 128 may vary along the radius 108 of the swirler vane 106 to form varied air swirl angles downstream of the swirler vanes 106 and/or downstream of the swirler portion 100.

As shown in FIGS. 4 and 5, the pressure side 118 and the suction side 120 may converge towards one another at the upstream end 110 to at least partially form the leading edge 122. Similarly, the pressure side 118 and the suction side 120 also converge towards one another at the downstream end 112 to at least partially form the trailing edge 124. The surface shapes of the pressure side 118 and the suction side 120 may vary along the swirler vanes 106 to ensure a smooth transition from the leading edge 122 to the trailing edge 124 at any radial location.

Figure 7:
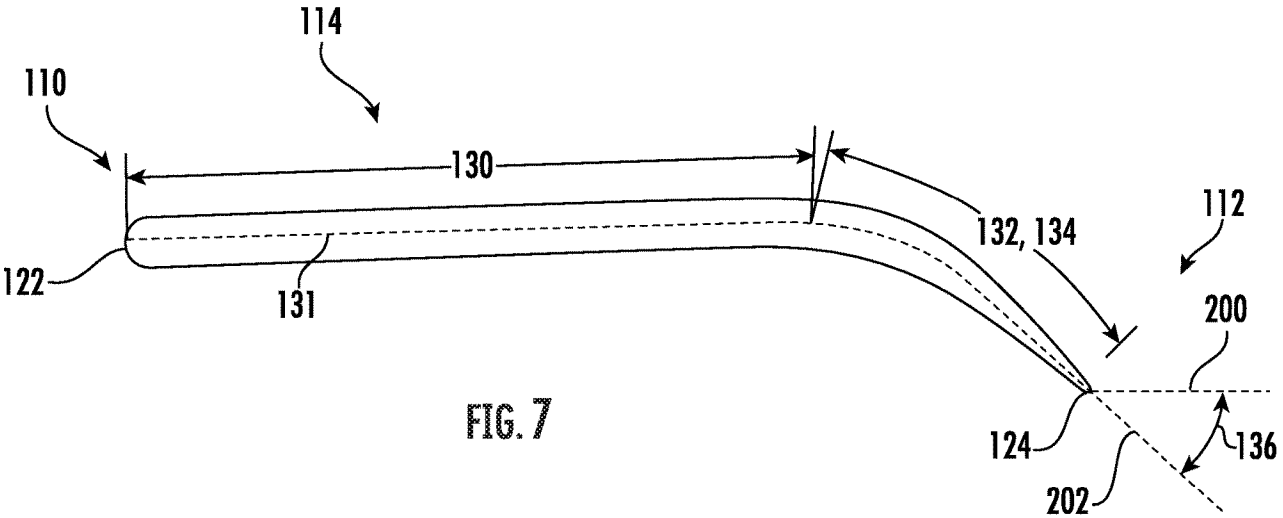
FIG. 7 illustrates a radially inner base of a swirler vane as in FIG. 6, in accordance with embodiments of the present disclosure.
Figure 8:
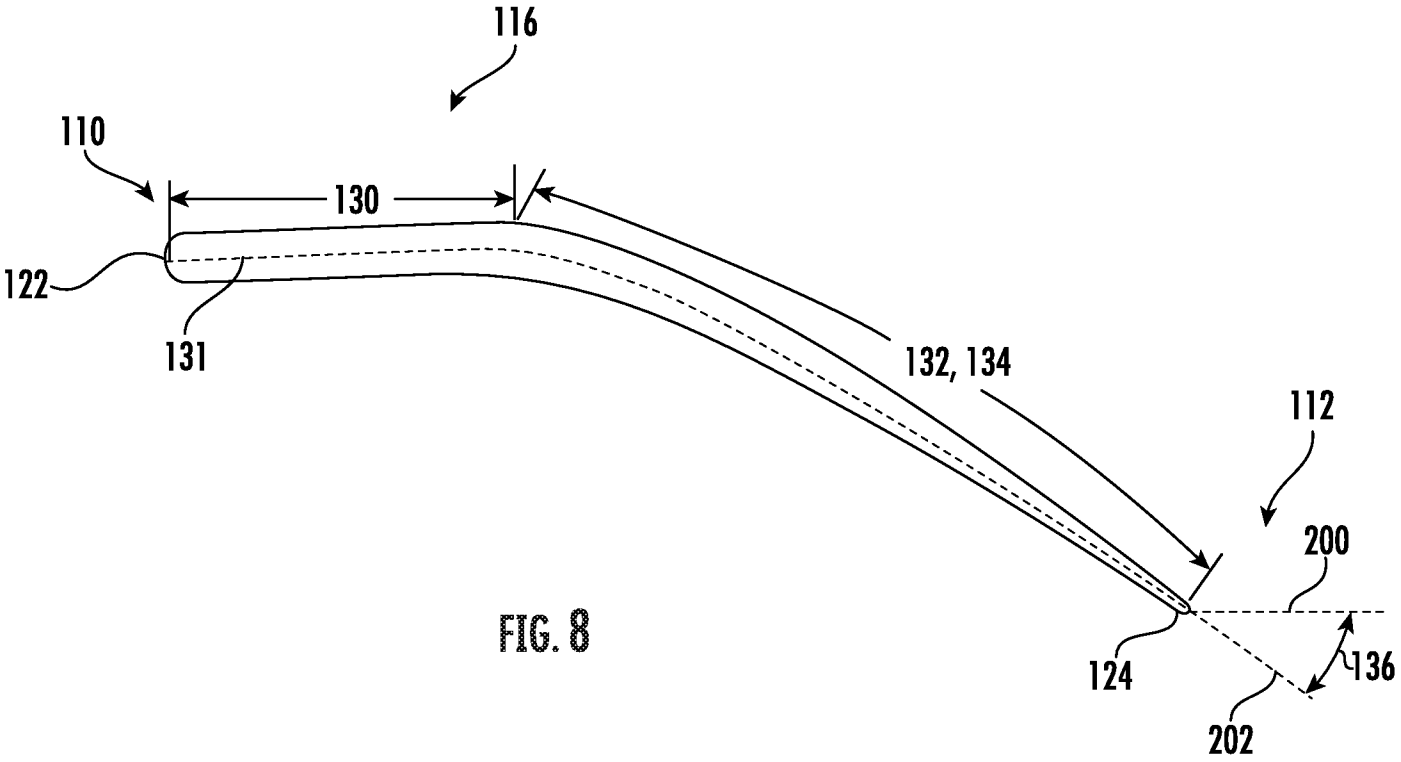
FIG. 8 illustrates a radially outer tip of a swirler vane as in FIG. 6, in accordance with embodiments of the present disclosure.

FIG. 6 illustrates a side view of a single swirler vane 106, FIG. 7 illustrates a side profile view of the radially inner base 114 of the swirler vane 106, and FIG. 8 illustrates a side profile view of the radially outer tip 116 of the swirler vane 106, in accordance with embodiments of the present disclosure. As shown in FIGS. 6 through 8, the swirler vane 106 may include a camber line 131. The camber line 131 may be defined halfway between the pressure side surface 126 and the suction side surface 128.

As shown, the pressure side surface 126, the suction side surface 128, and the camber line 131 may each further include an upstream portion 130 and a downstream portion 132. In many embodiments, the upstream portions 130 of the surfaces 126, 128 may extend from the leading edge 122 to the downstream portion 132. Similarly, the downstream portions 132 may extend from the upstream portion 130 to the trailing edge 124. As shown, the upstream portions 130 of the surfaces 126, 128 and the camber line 131 may be substantially flat and generally axially aligned. The downstream portion 128 may include an aerodynamic contour and/or curvature in the circumferential direction C that functions to induce a swirl on the air and/or fuel traveling within the swirler portion 100.

As shown, the upstream portions 130 may extend axially from the leading edge 122 and terminate once the surfaces 126, 128 begin to have a curvature and/or contour, i.e., where the downstream portion 132 begins. The curvature of the surfaces 126, 128 may begin at different locations along the swirler vane 106 depending on the radial location. Accordingly, the length of the upstream portion 130 and downstream portion 132 of the pressure side surface 126, the suction side surface 128, and the camber line 131 may vary along the radius 108 of the swirler vane 106.

As shown best in FIG. 5, in some embodiments, the downstream portion 132 of a swirler vane 106' in the plurality of swirler vanes 106 may extend circumferentially beyond the leading edge 122 of a neighboring swirler vane 106" in the plurality of swirler vanes 106. For example, the trailing edge 124 and at least a section of the downstream portion 132 of a swirler vane 106' may axially overlap with the leading edge 122 and the upstream portion 130 of a neighboring swirler vane 106" of the plurality of swirler vanes 106. Further, in many embodiments, the trailing edge 124 may be circumferentially offset from the leading edge 122.

Figure 9:
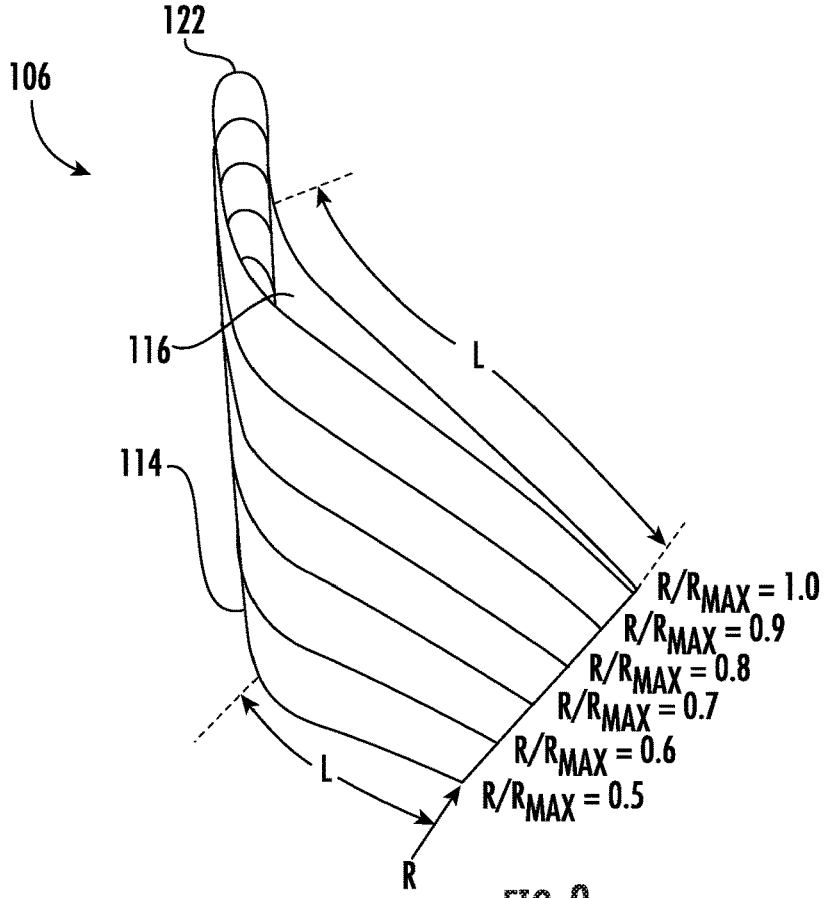
FIG. 9 illustrates a perspective view of a swirler vane as in FIG. 6, in accordance with embodiments of the present disclosure.
Figure 10:
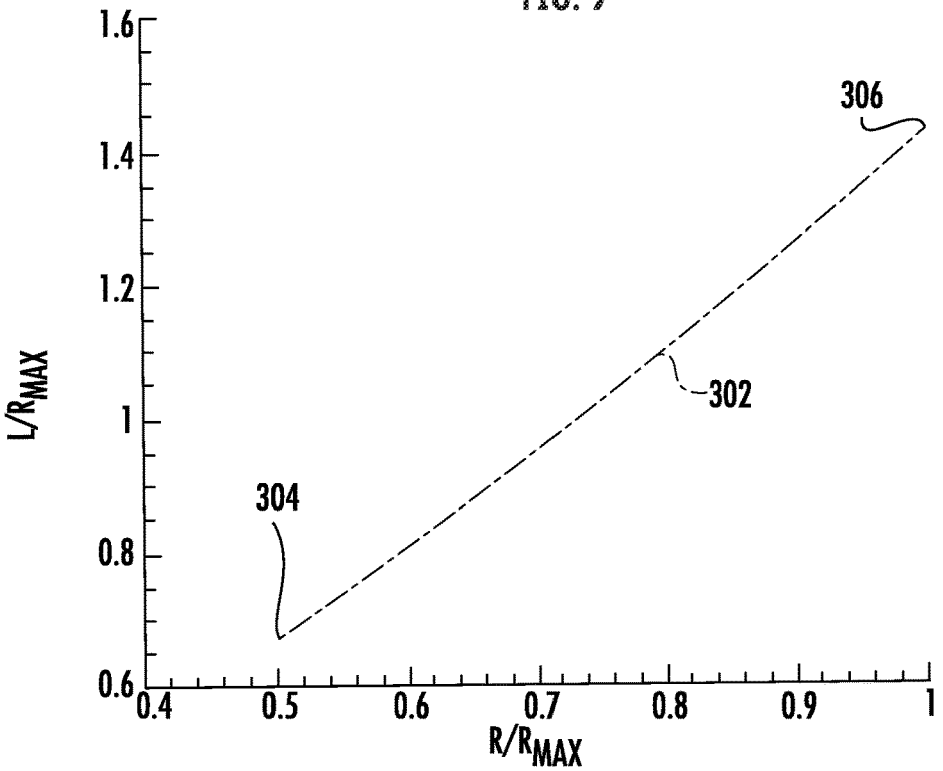
FIG. 10 is a graph that plots the relationship between the radial position on a swirler vane and the bend length of the swirler vane, in accordance with embodiments of the present disclosure.

As shown in FIGS. 6 through 8 collectively, the swirler vane 106 may further include a bend length 134 or L (FIGS. 9 and 10). The bend length 134 may be the length of the downstream portion 132, i.e. the length of the swirler vane 106 that is substantially arcuate, curved, and/or aerodynamically contoured. Specifically, the bend length 134 may be the length of the downstream portion 132 of the pressure side surface 126, the length of the downstream portion 132 of the suction side surface 128, or the length of the downstream portion 132 of the camber line 131. As used herein, "bend length 134" generally refers to the bend length 134 of the camber line 131, unless otherwise specified. In various embodiments, the bend length 134 of the pressure side surface 126, the bend length 134 of the suction side surface 128, and the bend length 134 of the camber line 131 may be the same or different.

As shown in FIG. 6 and discussed above, the bend length 134 for each of the pressure side surface 126, the suction side surface 128, and the camber line 131 may vary along the radius 108 of the swirler vane 106. For example, in many embodiments, the bend length 134 for each of the pressure side surface 126, the suction side surface 128, and the camber line 131 may be substantially longer at the radially outer tip 116 (FIG. 8) in comparison to the bend length 134 at the radially inner base 114 (FIG. 7). However, in other embodiments, the bend length 134 for each of the pressure side surface 126, the suction side surface 128, and the camber line 131 may be the same at the radially outer tip 116 and the radially inner base 114.

In many embodiments, the bend length 134 of the camber line 131 at the radially inner base 114 may be between about 40% and about 90% of the bend length 134 of the camber line 131 at the radially outer tip 116. In other embodiments, the bend length 134 of the camber line 131 at the radially inner base 114 may be between about 45% and about 85% of the bend length 134 of the camber line 131 at the radially outer tip 116. In some embodiments, the bend length 134 of the camber line 131 at the radially inner base 114 may be between about 50% and about 80% of the bend length 134 of the camber line 131 at the radially outer tip 116. In various embodiments, the bend length 134 of the camber line 131 at the radially inner base 114 may be between about 55% and about 75% of the bend length 134 of the camber line 131 at the radially outer tip 116.

In many embodiments, the bend length 134 may increase generally linearly from the radially inner base 114 to the radially outer tip 116. Accordingly, the bend length 134 may increase at a constant rate of change from the radially inner base 114 to the radially outer tip 116.

As shown in FIGS. 7 and 8, the swirler vane 106 may further include an exit flow angle 136. The exit flow angle 136 may be defined between the axial centerline 200 of the fuel nozzle 60 and a line 202 that is tangent to the camber line 131 at the trailing edge 124. The air and/or fuel may be deviated from the generally axial flow path defined by the upstream portion 130 of the surfaces 126, 128 towards the exit flow angle 136 by the downstream portion 132 of the surfaces 126, 128. Further, the exit flow angle 136 may be constant along the radius 108, i.e., the exit flow angle 136 does not change in the radial direction R. Accordingly, the distance required to deviate the air and/or fuel from a generally axial flow path to a flow direction that along the line 202, i.e., to offset the axial direction by the amount of the exit flow angle 136, may vary depending on the radial location of the air/fuel on the swirler vane 106. For example, the closer the fuel and/or air is to the centerbody 102, i.e. the further radially inward, the shorter the bend length 134 utilized to deviate the air/fuel towards the exit flow angle 136.

In many embodiments the exit flow angle may be between about 30° and about 60°. In other embodiments, the exit flow angle may be between about 35° and about 55°. In some embodiments, the exit flow angle 136 may be between about 40° and about 50°. In particular embodiments, the exit flow angle 136 may be about 45°.

FIG. 9 illustrates a perspective view of a swirler vane 106 in accordance with embodiments of the present disclosure. In FIG. 9, the $R/R_{max}$ values, i.e., the radial location along the swirler vane 106, are shown in increments of 0.1, and the radially outer tip 116 is transparent in FIG. 9 to show perspective. As shown, the bend length L (134 in FIGS. 6-8) increases along the radial direction R generally linearly.

FIG. 10 is a graph 300 that plots the relationship between the radial location of the swirler vane 106 and the bend length L. As shown in FIG. 10, the bend length L refers to the length of the downstream portion 132 of the camber line 131. Specifically, as shown, FIG. 10 shows a graph of a line 302 that shows relationship between the $L/R_{max}$ value, i.e., the bend length L normalized with respect to the maximum radial distance $R_{max}$, and the $R/R_{max}$ value. As shown by the plot, the bend length L increases linearly as the radius R increases. Likewise, as shown by the plot, the bend length L may increase with a constant (positive) rate of change due to the generally uniform slope of the line 300.

As shown in FIGS. 9 and 10 collectively, the ratio between the bend length L and the maximum radial distance $R_{max}$ is generally equal to 0.65 at the radially inner base 114, which is represented by point 304 in FIG. 10. Similarly, the ratio between the bend length L and the maximum radial distance $R_{max}$ is generally equal to 1.45 at the radially outer tip 116, which is represented by point 306 in FIG. 10. In other embodiments, the $L/R_{max}$ value may be as low as 0.4 at the radially inner base 114. $L/R_{max}$ values at the radially inner base 114 should not be lower than 0.4; otherwise, flow separation on the swirler vane 106 may occur.

In operation, linearly increasing the bend length L of the swirler vanes 106 functions to increase the overall flame-holding margin, thereby allowing for a larger volume of more reactive fuels to be utilized (fuels rich in hydrogen and dicarbon). The improved structure of the swirler vanes 106 described herein may advantageously allow for the use of an axial fuel staging system (or secondary combustion system) without negatively impacting the flameholding margin of the fuel nozzles (or primary combustion system). Specifically, the structure of the swirler vanes 106 prevents flow separation in the primary fuel nozzles 60 that might otherwise occur when a significant portion of the total airflow volume to the head end portion 38 of the combustor 17 is diverted to the downstream axial fuel staging injectors (not shown) for secondary combustion.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims, if they include structural elements that do not differ from the literal language of the claims, or if they include equivalent structural elements with insubstantial differences from the literal language of the claims.

What is claimed is:

1. A fuel nozzle comprising:
- a centerbody extending axially with respect to a centerline of the fuel nozzle;
- a confining tube radially outward of the centerbody;
- a plurality of swirler vanes disposed between the centerbody and the confining tube, each of the plurality of swirler vanes comprising:
  - a radially inner base and a radially outer tip;
  - an upstream portion extending from a leading edge; and
  - a downstream portion extending from the upstream portion to a trailing edge, the downstream portion defining a bend length between the upstream portion and the trailing edge, wherein the bend length at the radially outer tip is greater than the bend length at the radially inner base;
  - wherein each swirler vane of the plurality of swirler vanes defines an exit flow angle at the trailing edge that is constant from the radially inner base to the radially outer tip.

2. The fuel nozzle as in claim 1, wherein the upstream portion of each swirler vane is generally flat and axially oriented with respect to the centerline of the fuel nozzle.

3. The fuel nozzle as in claim 1, wherein a maximum radial distance is defined between the centerline of the fuel nozzle and the confining tube, and wherein a ratio between the bend length at the radially inner base and the maximum radial distance is greater than 0.4.

4. The fuel nozzle as in claim 1, wherein the bend length at the radially inner base is between about 40% and about 90% of the bend length at the radially outer tip.

5. The fuel nozzle as in claim 1, wherein the bend length of each swirler vane of the plurality of swirler vanes generally linearly increases from the radially inner base to the radially outer tip.

6. The fuel nozzle as in claim 1, wherein the downstream portion of a swirler vane in the plurality of swirler vanes extends circumferentially beyond the leading edge of a neighboring swirler vane in the plurality of swirler vanes.

7. The fuel nozzle as in claim 1, wherein each swirler vane of the plurality of swirler vanes comprises a pressure side and a suction side.

8. The fuel nozzle as in claim 7, wherein the exit flow angle is defined between the centerline of the fuel nozzle and a line tangent to the pressure side at the trailing edge.

9. The fuel nozzle as in claim 8, wherein the exit flow angle is between about 30° and about 60°.

10. A turbomachine comprising:
- a compressor section;
- a turbine section; and
- a combustion section comprising a plurality of fuel nozzles, each fuel nozzle of the plurality of fuel nozzles comprising:
  - a centerbody extending axially with respect to a centerline of the fuel nozzle;
  - a confining tube radially outward of the centerbody;
  - a plurality of swirler vanes disposed between the centerbody and the confining tube, each of the plurality of swirler vanes comprising:
    - a radially inner base and a radially outer tip;
    - an upstream portion extending from a leading edge; and
    - a downstream portion extending from the upstream portion to a trailing edge, the downstream portion defining a bend length between the upstream portion and the trailing edge, wherein the bend length at the radially outer tip is greater than the bend length at the radially inner base;
    - wherein each swirler vane of the plurality of swirler vanes defines an exit flow angle at the trailing edge that is constant from the radially inner base to the radially outer tip.

11. The turbomachine as in claim 10, wherein the upstream portion of each swirler vane is generally flat and axially oriented with respect to the centerline of the fuel nozzle.

12. The turbomachine as in claim 10, wherein the downstream portion of each swirler vane is generally arcuate.

13. The turbomachine as in claim 10, wherein the bend length at the radially inner base is between about 40% and about 90% of the bend length at the radially outer tip.

14. The turbomachine as in claim 10, wherein the bend length of each swirler vane of the plurality of swirler vanes generally linearly increases from the radially inner base to the radially outer tip.

15. The turbomachine as in claim 10, wherein the downstream portion of a swirler vane in the plurality of swirler vanes extends circumferentially beyond the leading edge of a neighboring swirler vane in the plurality of swirler vanes.

16. The turbomachine as in claim 10, wherein each swirler vane of the plurality of swirler vanes comprises a pressure side and a suction side.

17. The turbomachine as in claim 16, wherein the exit flow angle is defined between the centerline of the fuel nozzle and a line tangent to the pressure side at the trailing edge.

18. The turbomachine as in claim 17, wherein the exit flow angle is between about 30° and about 60°.

* * * * *